US005718389A

United States Patent [19]

Finken et al.

[11] Patent Number: 5,718,389

[45] Date of Patent: Feb. 17, 1998

[54] CRUSHING MACHINE AND METHOD FOR THE AUTOMATIC ADJUSTMENT OF THE CRUSHING GAP THEREOF

[75] Inventors: Wolfgang Finken, Ennigerloh; Hans-Jürgen Müller, Usingen, both of Germany

[73] Assignee: Krupp Fördertechnik GmbH, Duisburg, Germany

[21] Appl. No.: 617,329

[22] Filed: Mar. 18, 1996

[30] Foreign Application Priority Data

Mar. 25, 1995 [DE] Germany ..... 195 11 097.8

[51] Int. Cl.[6] ..... B02C 13/09

[52] U.S. Cl. ..... 241/27; 241/37; 241/189.1; 241/290

[58] Field of Search ..... 241/27, 37, 189.1, 241/290, 30

[56] References Cited

U.S. PATENT DOCUMENTS

| | | | |
|---|---|---|---|
| 4,084,752 | 4/1978 | Hagiwara et al. | 241/30 |
| 4,729,517 | 3/1988 | Krokor et al. | 241/189.1 |
| 4,799,625 | 1/1989 | Weaver, Jr. et al. | 241/30 |
| 5,226,604 | 7/1993 | Seiffert et al. | 241/30 |
| 5,443,215 | 8/1995 | Fackler | 241/101.3 |

FOREIGN PATENT DOCUMENTS

| | | |
|---|---|---|
| E 1846 | 10/1983 | Australia . |
| 1331044 | 7/1994 | Canada . |
| 0 391 096 | 10/1990 | European Pat. Off. . |
| 0 513 479 | 11/1992 | European Pat. Off. . |
| 2018496 | 10/1971 | Germany . |
| 35 25 101 | 1/1987 | Germany . |
| 36 21 400 | 1/1988 | Germany . |
| 41 16 134 | 11/1992 | Germany . |

*Primary Examiner*—John M. Husar
*Attorney, Agent, or Firm*—Spencer & Frank

[57] ABSTRACT

A crushing machine includes a housing; a rotor rotatably supported in the housing; a plurality of impact tools secured circumferentially to the rotor; and an impact apron pivotally supported in the housing. The impact apron cooperates with the impact tools for crushing a material therebetween. A control device is connected to the impact apron for setting the impact apron at a selected distance from the impact tools to define a crushing gap. There is further provided a measuring device for measuring oscillations of the impact apron upon contact thereof with the impact tools during rotation of the rotor.

22 Claims, 2 Drawing Sheets

CRUSHING MACHINE AND METHOD FOR THE AUTOMATIC ADJUSTMENT OF THE CRUSHING GAP THEREOF

CROSS REFERENCE TO RELATED APPLICATION

This application claims the priority of German Application No. 195 11 097.8 filed Mar. 25, 1995, which is incorporated herein by reference.

BACKGROUND OF THE INVENTION

This invention relates to a method for the automatic adjustment of the crushing gap of a crushing machine which includes a rotor provided with circumferentially arranged impact tools as well as a pivotally supported impact device (hereafter referred to as an impact apron) whose distance from the impact tools is adjustable. For this purpose, the impact apron is first pivoted toward the rotor until the impact apron touches the impact tools during rotor run. Such a setting for the impact apron is considered as the zero position. Thereafter the impact apron is pivoted away from the rotor to an extent which corresponds to the desired crushing gap defined between the impact tools carried by the rotor and the impact apron.

The invention further relates to a crushing machine, particularly an impact crusher having at least one rotor which is provided with circumferentially arranged impact tools and which is rotatably supported in the crusher housing. The rotor cooperates with at least one impact apron which is pivotally supported in the crusher housing and whose distance from the impact tools is adjustable. The crushing machine further includes a measuring device determining a position in which the rotary impact tools slidingly contact the appropriately pivotally positioned impact apron and a control device for pivoting the impact apron away from the rotor to set a predetermined crushing gap.

A method and an apparatus of the above-outlined kind are disclosed in European Patent No. 0 391 096. As explained in that patent, the impact tools which are generally constituted by impact strips, as well as the impact apron are exposed to wear, as a result of which an initially set crushing gap gradually increases so that the crushed product will become gradually coarser. In order to compensate for such a wear, according to the prior art, the impact apron is pivotally held in the crusher housing and is adjusted to the desired crushing gap by means of a setting cylinder unit. Impact aprons are further known which are resiliently supported in the crusher housing so that the impact apron may pivotally yield to large pieces of material to be crushed and particularly to foreign bodies such as metal parts for avoiding damage to the impact apron and the rotor.

In heavy duty impact crushers the dimensioning and arrangement of springs as well as the setting spindles cause problems and render the setting of the crushing gap difficult. To make possible a compact design of the springs and setting elements for the purpose of a remote-controlled setting of the crushing gap between the impact strips, on the one hand and the impact apron on the other hand, German Offenlegungsschrift (application published without examination) 35 25 101 proposes to connect the impact apron jointedly with the piston rod of a damping piston which is supported in the crusher housing and whose forward terminal position is steplessly variable by an adjusting piston of a setting cylinder unit. The use of a damping cylinder instead of mechanical springs makes possible not only the generation of high counterforces and large compensating paths with the smallest spatial requirements, but also provides for a stepless remote setting of the crushing gap between the impact strips of the rotor and the steel plates of the impact apron. Preferably, the damping cylinder is filled with a pressure medium and is in hydraulic communication with an accumulator whose biassing pressure is adjustable in order to adapt the damping characteristics to the actual use conditions. Further, in the impact crusher described in the above-identified German Offenlegungsschrift, the motion of the impact apron toward the rotor is positively limited by providing an abutment on a rod extending outwardly from the reverse side of the cylinder housing in a fluidtight manner. Originally, the adjustment of the crushing gap has been made while the crusher was at a standstill and, after opening the housing, the distance between the impact strips of the rotor and the impact apron has been individually set. German Auslegesschrift (application published after examination) 20 18 496 teaches a readjustment of the impact apron during operation by means of contactless limit sensors which are to prevent the impact apron, which is adjustable as a function of the granular composition of the crushed material, from contacting the impact strips carried by the rotor. Such a solution, however, has not been carried out in practice because of handling difficulties.

As described in the second column of European Patent No. 0 391 096, it has been already attempted to set the most favorable crushing gap by periodically moving the impact apron slowly towards the rotor during an empty run of the crushing machine and detecting, by a microphone, a contact between the impact strips of the rotor and the impact apron, and then moving the impact apron away from the rotor by a measurable distance which corresponds to the desired crushing gap. The required switching operations such as the energization of the setting drive for the impact apron, the reversal of motion after the microphone has signalled a contact and the deenergization of the setting drive after a reverse motion of the impact apron through a desired path were performed manually. Such an adjusting procedure of the crushing gap has also been proven difficult in practice because it largely depended from the skill and observation capabilities of operating personnel.

According to the above-identified European patent, for setting the impact apron automatically, the crusher housing supports a microphone which is connected with a computer that controls the drive of the impact apron as a function of the microphone signals. Thus, the drive sets the impact apron in motion towards the rotor upon generation of a signal indicating an interruption of material input, and the signal is applied to the computer with such a delay that by the time the signal reaches the computer, the crusher is empty and a signal prevails which is transmitted by the microphone and which corresponds to the usual operating noises of the crusher. The motion of the impact apron is reversed when the computer receives from the microphone a signal which—after filtering out the general operating noises—represents the hard impact noises generated when the impact apron contacts the impact tools of the revolving rotor.

The method and the apparatus for performing the method described in the above-noted European patent is disadvantageous in that apart from the high circuit-technological outlay, a high software outlay is also necessary to detect the idle-run noises of the crusher and to determine the threshold values based thereon. Also, external jars or other noises are likely to be detected by the microphone, resulting in erroneous control signals.

SUMMARY OF THE INVENTION

It is an object of the invention to provide an improved method and apparatus of the above-discussed type which ensure an interference-free automatic crushing gap adjustment.

This object and others to become apparent as the specification progresses, are accomplished by the invention, according to which, briefly stated, the crushing machine includes a housing; a rotor rotatably supported in the housing; a plurality of impact tools secured circumferentially to the rotor; and an impact apron pivotally supported in the housing. The impact apron cooperates with the impact tools for crushing a material therebetween. A control device is connected to the impact apron for setting the impact apron at a selected distance from the impact tools to define a crushing gap. There is further provided a measuring device for measuring oscillations of the impact apron upon contact thereof with the impact tools during rotation of the rotor.

The invention is based on the principle that upon moving the impact apron in the direction of the rotor, the pivotal motion is first unimpeded until, upon a contact between the impact apron and the revolving rotor, blows are delivered to the impact apron by the revolving impact tools. Such blows not only prevent the pivotal forward motion of the impact apron but, caused by a pressure limiting valve, effect short-period reverse motions of the impact apron. The oscillating frequency of the impact apron is directly proportionate to the rpm of the rotor and thus, also to the number of blows delivered by the impact tools of the rotor to the impact apron. Further, in case of non-uniform oscillation amplitudes, a direct conclusion may be drawn that the impact strips of the rotor have a non-uniform radial distance from the rotary axis of the rotor. The measurements of the oscillations of the impact apron permit, in contrast to acoustic sound measurements, a more accurate determination of the location where the distance of the impact apron from the impact tools of the rotor is zero. Such a zero position may be directly recorded and, simultaneously with the recording motion, a rearward pivotal motion of the impact apron is initiated throughout a path which corresponds to the desired crushing gap.

Preferably, the oscillation frequency and/or the oscillation amplitude are measured. A measurement of the frequency within the frequency range predetermined by the rotor frequency as well as the overstepping of an amplitude threshold value are reliable indicators that contact between the impact tool of the rotor and the impact apron has occurred.

According to a preferred embodiment of the invention, the oscillations are determined indirectly by measuring the pressure in a cylinder chamber of a setting cylinder of the impact apron or are determined directly by an external path sensor or a path sensor which is integrated in the setting cylinder or by means of an angular displacement sensor. These pressure, path or angle measurements may be performed expediently by integrated structural components in the impact apron. Or, already-existing crushing mills may be retrofitted with such components.

The process according to the invention is particularly adapted for use with hydraulically adjustable impact aprons.

According to another embodiment of the invention, the path travelled by the piston rod of the setting cylinder unit is limited by a preferably hydraulically adjustable abutment device. Such an abutment device, as opposed to a mechanical securement formed essentially by a counternut (as described in German Offenlegungsschrift 35 25 101), has the advantage that the relative displacement of the piston rod which causes a pivotal motion of the impact apron, may be individually adjusted. In particular, the wear of the impact strips or other impact tools or the non-uniform radial distances of the impact strips caused by a rotor replacement may be detected without difficulty. The hydraulically adjustable abutment device is preferably remote-controlled and thus may be automated.

The crushing machine according to the invention has an oscillation measuring device which is directly or indirectly connected with the impact apron. Preferably, the oscillation measuring device is designed for determining frequency and amplitude values and is connected with a control device which serves for the setting of the impact apron and with which other relevant magnitudes such as rotor frequency, may also be detected.

According to a preferred embodiment of the crushing machine, the oscillation measuring device is a pressure detector which is arranged in the cylinder chamber or in a supply conduit of a setting cylinder unit of the impact apron. Apart from its robust structure, the integrated pressure detector has the advantage that it is disposed in a protective environment. The pressure detector makes possible the recording of pressure waves which are generated when blows are delivered to the impact apron and are transferred to the piston rod and eventually to the pressure medium such as hydraulic oil, present in the cylinder chamber of the setting cylinder unit.

According to an alternative embodiment of the invention, the oscillation measuring device is composed of an external path sensor or a path sensor which is integrated with the setting cylinder unit or an angular displacement sensor which is arranged at the pivot joint of the impact apron. Hydraulic cylinders with path sensors for determining the momentary position of the piston are in principle conventional as are angular displacement measuring devices which may be designed as angle coders. The angular displacement sensors, similarly to the path sensor, operate without wear and have a high resolution accuracy and reliability and, in particular, erroneous control signals cannot occur which may be present in case of an "acoustic ear" realized by a microphone according to European Patent 0 391 096.

The impact apron is displaceable preferably by a hydraulic arrangement.

The coupling of the impact apron with a setting cylinder unit which is articulated to the crusher housing by means of a pivot pin, makes possible a rapid attachment of the setting cylinder unit, as well as a rapid release thereof. Also, the possibility is provided that by means of a clamping head an individual terminal abutment may be adjusted, for example, by remote control, which limits the travel path of the piston and thus restricts the pivotal path of the impact apron. The clamping head is preferably connected with a dashpot arrangement of the setting cylinder unit. According to an advantageous feature of the invention, the clamping head immobilizes a securing rod which has, at its end, an abutment head for the piston rod of the setting cylinder unit. The clamping head and/or the securing rod are preferably hydraulically operable.

According to another feature of the invention, the clamping head, the securing rod and/or the piston rod are operable by means of one and the same hydraulic control circuit; this reduces to the minimum the number of the required structural components.

In order to prevent the impact apron from causing, during its outward pivotal motion, an excessive speed of the piston rod due to the pulling load, a biasing valve is provided in the pressure conduit which communicates with the corresponding cylinder chamber of the setting cylinder unit.

As described in principle in German Offenlegungsschrift 35 25 101, the impact apron is preferably connected by means of a joint with the piston rod of a setting cylinder unit which is countersupported by the crusher housing and in which the frontal terminal position of the piston rod is steplessly adjustable by a setting piston formed as a securing rod. By means of this measure, the setting member for the impact apron may have minimum spatial requirements. Preferably, the cylinder chamber of the setting cylinder is filled with a hydraulic liquid and communicates with an accumulator whose bias pressure is adjustable to limit the maximum crushing force.

The maximum pressure forces in the cylinder chamber are, according to a further feature of the invention, limited by a precision-controlled pressure limiting valve.

According to yet another feature of the invention, the cylinder chamber is secured by a pressure limiting valve whose control circuit is leak-free so that the hydraulic pump may be deenergized after setting the crushing gap, preferably until a pressure sensor of the control circuit indicates a pressure drop and again activates the hydraulic pump. Replenishment of the hydraulic fluid to compensate for slight leaks may be effected, for example, by means of an accumulator provided in the control circuit.

The piston of the setting cylinder unit is preferably designed as a differential piston. The securing rod is sealed by the clamping device up to the cylinder chamber of the setting cylinder and is passed through the rear side of the setting piston. The setting piston has an inner chamber whose annular bottom countersupports the underside of the head of the securing rod.

DESCRIPTION OF THE PREFERRED EMBODIMENT

Figure 1:
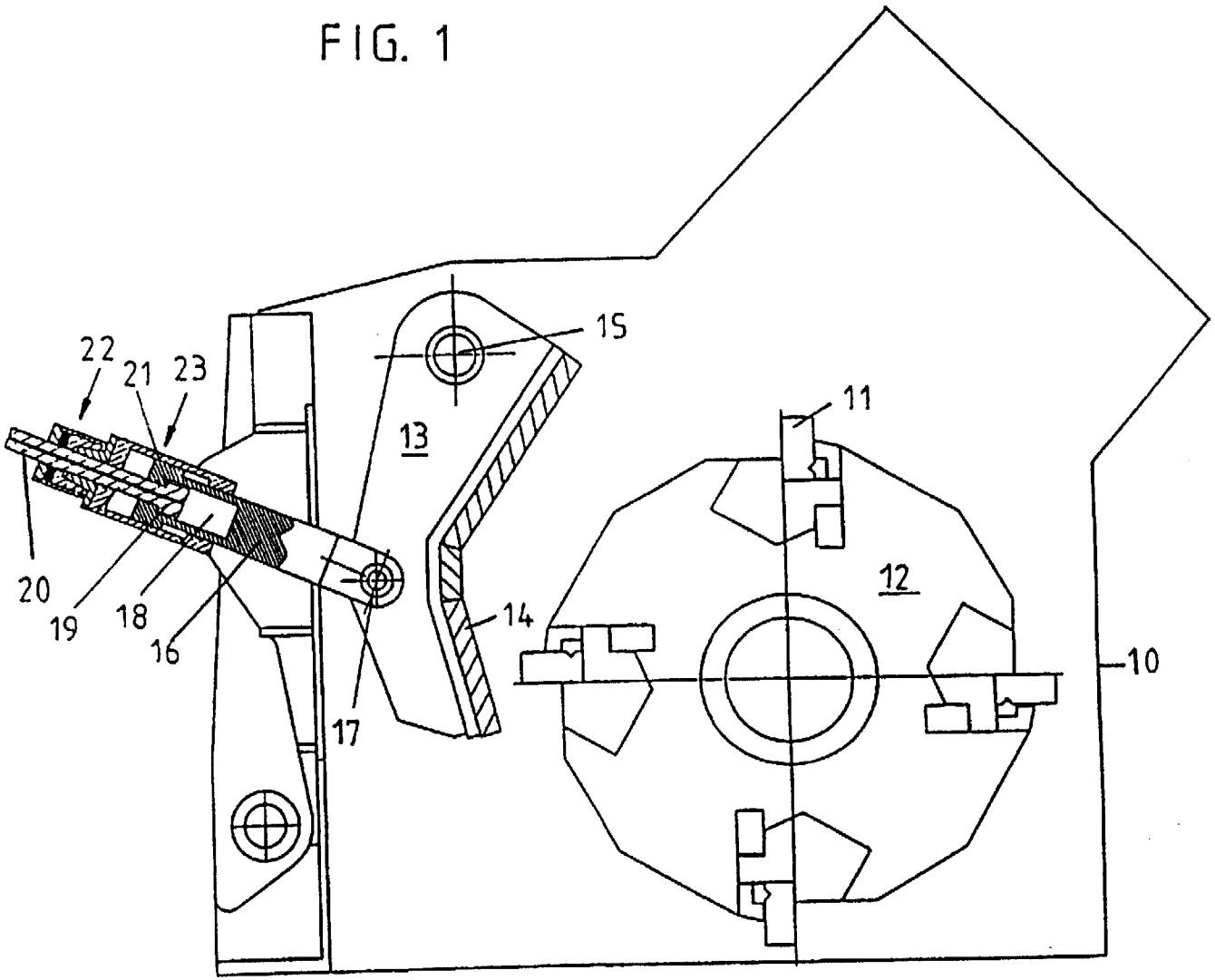
FIG. 1 is a schematic side elevational view of a crushing device including a pivotally supported impact apron, a setting device therefor and a rotor provided with impact strips cooperating with the impact apron.

The crushing machine shown in FIG. 1 is an impact crusher including a crusher housing 10 and a rotor 12 which is rotatably supported in the crusher housing 10 and which carries on its periphery a plurality of circumferentially spaced impact strips 11. The inputted material is thrown by the impact strips 11 against an impact apron 13 which has armor plates 14 facing the rotor 12. The impact apron 13 is pivotally held by a pivot 15 and may be angularly displaced by a piston rod 16 which forms part of a setting cylinder unit 23 and which is connected with the impact apron 13 by a joint 17. The piston rod 16 has a chamber 18 into which extends the head 19 of a securing rod 20. In its end position shown in FIG. 1, the annular underside of the head 19 engages the annular bottom 21 of the chamber 18. The securing rod 20 cooperates with a clamping device 22 which is connected to the setting cylinder unit 23.

Figure 2:
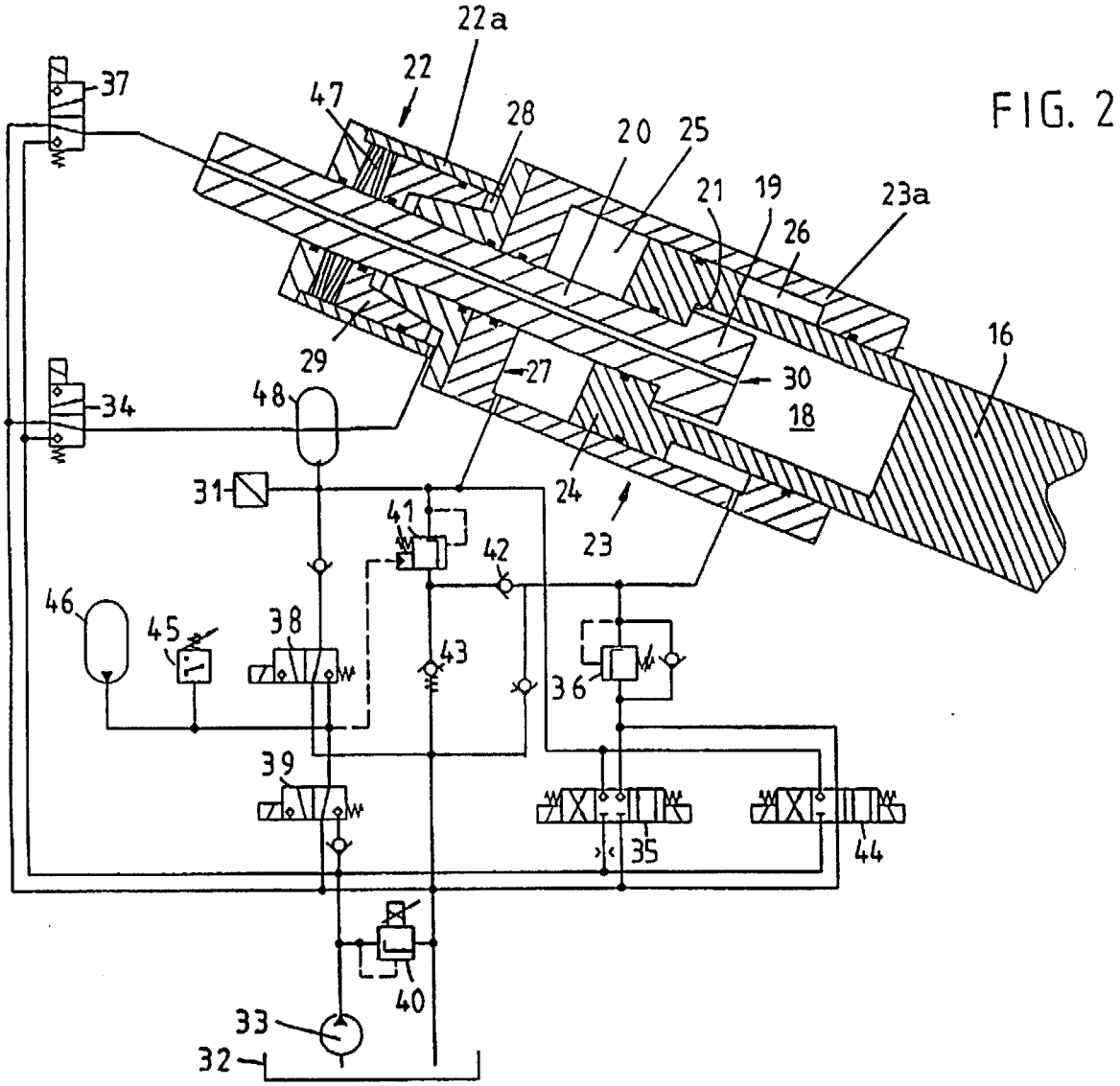
FIG. 2 is an enlarged sectional view of the setting device shown in FIG. 1 connected with a hydraulic control circuit according to the invention.

Also referring to FIG. 2, the piston rod 16 terminates in a differential piston 24 which is slidingly guided in a work chamber of a cylinder sleeve **23*a*, forming part of the setting cylinder unit 23. The work chamber is divided by the piston 24 into opposite cylinder chambers 25 and 26. The position of the piston-and-rod assembly 16, 24 is adjustable by means of a pressure medium admitted to or withdrawn from the cylinder chambers 25 and 26. The securing rod 20 sealingly passes through the piston 24 and the rearward bottom 27 forming part of the cylinder sleeve 23*a* and bounding the annular cylinder chamber 25. The cylinder chambers 25 and 26 are annular due to the passage therethrough of the piston rod 16 and the securing rod 20**, respectively.

The clamping device 22 comprises a cylinder sleeve **22*a* defining a work chamber 28 in which a setting block (clamping piston) 29 is slidably disposed. The setting block 29 may be displaced against the force of a clamping spring assembly 47 by hydraulic pressure introduced into the work chamber 28. Thus, when the chamber 28 is depressurized, the clamping spring assembly 47 assumes its expanded state in which it wedges against the securing rod 20, immobilizing it in its axial position. When the chamber 28 is pressurized by switching the valve 34 which allows pressurized hydraulic fluid to flow into the chamber 28, the pressure drives the clamping piston 29 against the spring assembly 47 and compresses the same, whereupon the clamping (wedging) effect of the spring assembly 47 is removed from the securing rod 20, allowing it to axially slide relative to the clamping head 22. The securing rod 20 has a longitudinal axial bore 30 through which a hydraulic medium may flow into or out of the chamber 18 of the piston rod 16**.

On the bottom 27 of the cylinder chamber 25 or, as illustrated in FIG. 2, in a supply conduit merging into the cylinder chamber 25 close to the bottom 27, a pressure sensor 31 is arranged which, by means of non-illustrated control conductors, is connected with a control device for the hydraulic circuit. The hydraulic control circuit has a sump 32 from which hydraulic liquid is drawn by a pump 33. For pivoting the impact apron 13 in the direction of the rotor 12, first the valve 34 is switched whereby the mechanical clamping (immobilization) of the securing rod 20 is released. Thereafter the valve 35 is switched into its right-hand position whereby the cylinder chamber 25 is pressurized, while the cylinder chamber 26 is placed in hydraulic communication with the sump 32 through the biasing valve 36. The biasing valve 36 prevents the piston rod 16 from moving with an excessive speed urged to do so by the traction load. It has to be ensured that the piston rod 16 moves outwardly from the cylinder sleeve **23*a*** at a low speed controlled, for example, by a proportional path valve.

As soon as the armor 14 of the impact apron 13 contacts the impact strips 11, the thus-generated blows on the piston rod 16 are transformed into pressure waves in the cylinder chamber 25. The pressure waves depend from the rpm of the rotor, the number of the impact strips 11 and further from the radial distance of the impact strips 11 from the rotor axis. The pressure pulses are sensed by the pressure sensor 31 and are evaluated by a computer or an electronic unit by determining the frequency and amplitude.

If the frequency is within a predetermined value determined by the frequency range of the motor and the amplitude exceeds a predetermined magnitude, the momentary position of the impact apron 13 is stored in the electronic unit as a zero position of the crushing gap. At the same time or subsequently, by moving the setting piston 16 into the cylinder sleeve **23*a*, the impact apron 13 is pivoted away from the rotor 10 and thus the desired crushing gap is set. To effect such a displacement, the valve 35 is placed into its left-hand switching position and the vale 37 is switched, whereby the chambers 26 and 18 are pressurized. The inward motion of the piston rod 16 is coupled with a corresponding outward motion of the securing rod 20. During such a displacement, the valve 34 is switched whereby the mechanical clamping of the clamping device 22 is released. When the crushing gap is adjusted to the desired value, the valve 34 is switched off, whereupon the mechanical clamping of the securing rod 20 by the spring assembly 47 again takes effect. Thereafter the cylinder chamber 25 is pressurized by means of the valves 38 and 39, while the pressure may be steplessly set by means of the valve 40. Such a pressure also determines the setting pressure of the pressure limiting valve 41 and limits the maximum crushing force. By means of the described measure, the piston rod 16 is prevented from moving outwardly from the cylinder sleeve 23***a* by the securing rod 20 and is hydraulically biased in the other direction, resulting in an immobilization of the piston rod 16. If the crushing force exceeds the setting pressure of the pressure limiting valve 41, the latter opens, allowing hydraulic fluid to flow from the cylinder chamber 25 through the check valve 42 into the cylinder chamber 26 and any excess quantity of hydraulic liquid may flow back into the sump 32 through the check valve 43. The position of the securing rod 20 remains unchanged during these occurrences. By switching the valve 42, the desired setting of the impact apron 13 may be effected immediately and at a high speed. An overdrive of the preset crushing gap is not possible because the head 19 of the securing rod 20 prevents such an additional motion.

The valve 41 and its control are leak-free, whereby the respective hydraulic pump may be deenergized after setting.

The valves 38 and 39 must always be in their energized state during the crushing operation. Any pressure drop in the hydraulic control circuit is determined by the pressure switch 45, causing again actuation of the above-described valves. An accumulator 46 compensates for any slight leakages.

The cylinder chamber 25 of the setting cylinder unit 23 is filled with a hydraulic liquid and is in communication with an accumulator 48 whose biasing pressure may be altered for limiting the maximum crushing force.

As an alternative to the above-described device operating on the basis of the pressure sensor 31, the setting cylinder unit 23 may be provided with a path sensor which detects the absolute position of the piston rod 16 in a time-dependent manner and records the forward motions during the outwardly directed displacement of the piston rod 16 as well as the rearward motions caused by the blows delivered by the impact strips 11 to the impact apron 13. Upon first appearance of such rearward motions, the associated position of the piston rod 16 is stored as the zero position. In a similar manner, immediately at the pivot 15 an angular displacement sensor may determine the angular position of the impact apron 13 as a function of time.

The invention also includes embodiments in which the pressure sensor 13 as well as the above-noted path sensor or angular displacement sensor are simultaneously present which significantly increases the operational safety of the crushing machine.

As an alternative to the path measuring device integrated in the setting cylinder unit, external path sensor devices may also be used. Such devices are particularly advantageous for retrofitting crushing machines which have been originally installed without internal path sensing arrangements.

By virtue of the invention, a substantial structural and/or control-technological outlay—as it is the case when, for example, a microphone is used—is advantageously avoided. Operating errors which occasionally may lead to a destruction of the impact apron or the rotor, cannot occur.

It will be understood that the above description of the present invention is susceptible to various modifications, changes and adaptations, and the same are intended to be comprehended within the meaning and range of equivalents of the appended claims.

What is claimed is:

1. In a method of automatically setting a crushing gap of a crushing machine; the crushing machine including a rotor; impact tools secured circumferentially to the rotor; and a pivotally supported impact apron movable towards and away from the rotor and defining an adjustable crushing gap with the impact tools; including the steps of rotating the rotor;

during the rotating step, pivoting the impact apron towards the rotor until the impact apron assumes a zero position in which the impact apron contacts the impact tools;

after the impact apron has reached said zero position, pivoting said impact apron away from said rotor until a desired crushing gap is reached;

the improvement comprising the following steps:

(a) measuring oscillations of said impact apron; and (b) recording said zero position when a predetermined threshold value of said oscillations is exceeded.

2. The method as defined in claim 1, wherein said threshold value is at least one of the frequency of oscillation and the amplitude of oscillation.

3. The method as defined in claim 1, wherein the measuring step comprises the step of measuring a hydraulic pressure in a cylinder chamber, generated by forces derived from said oscillations by a component connected to said impact apron and extending into said cylinder chamber.

4. The method as defined in claim 1, wherein the measuring step comprises the step of measuring displacements of said impact apron with a path sensor.

5. The method as defined in claim 1, wherein the measuring step comprises the step of measuring angular displacements of said impact apron with a rotary angle measuring device.

6. The method as defined in claim 1, further comprising the step of hydraulically pivoting said impact apron.

7. The method as defined in claim 3, further comprising the step of limiting displacements of said component by an adjustable abutment device.

8. A crushing machine comprising (a) a housing;

(b) a rotor rotatably supported in said housing;

(c) a plurality of impact tools secured circumferentially to said rotor;

(d) an impact apron pivotally supported in said housing; said impact apron cooperating with said impact tools for crushing a material therebetween;

(e) a control device connected to said impact apron for setting said impact apron at a selected distance from said impact tools to define a crushing gap; and (f) measuring means for measuring oscillations of said impact apron upon contact thereof with said impact tools during rotation of said rotor.

9. The crushing machine as defined in claim 8, wherein said measuring means is connected to said control device and includes means for determining frequencies and amplitudes of said oscillations.

10. The crushing machine as defined in claim 8, wherein said control device comprises a setting cylinder unit including a cylinder sleeve defining a cylinder chamber, a piston slidably received in said cylinder sleeve and bordering said cylinder chamber and a piston rod extending from said piston and connected to said impact apron whereby pressure variations in said cylinder chamber represent said oscillations of said impact apron; further wherein said measuring means includes a pressure sensor communicating with said cylinder chamber for measuring pressures therein.

11. The crushing machine as defined in claim 10, further comprising means for supporting said cylinder sleeve in said housing.

12. The crushing machine as defined in claim 10, wherein said control device comprises a hydraulic circuit for moving said impact apron.

13. The crushing machine as defined in claim 12, wherein said hydraulic circuit contains biasing valve means for preventing an excessive speed of said impact apron during movement thereof away from said impact tools.

14. The crushing machine as defined in claim 12, wherein said control device further comprises (a) a securing rod traversing said cylinder sleeve in an axial direction thereof and being slidably supported thereby;

(b) connecting means for attaching said securing rod to said piston;

(c) clamping means for selectively immobilizing or releasing said securing rod to hold said impact apron in, or releasing said impact apron from a set position; said clamping means comprising (1) a clamping head mounted on said cylinder sleeve and being traversed by said securing rod;

(2) a clamping device accommodated in said clamping head; said clamping device having a clamping position in which said securing rod is tightened to said clamping head and a released position in which said securing rod is displaceable relative to said clamping head; and (3) means coupling said hydraulic circuit to said clamping device for selectively placing said clamping device in one of said positions.

15. The crushing machine as defined in claim 14, wherein said clamping device comprises (a) a clamping spring assembly accommodated in said clamping head and surrounding said securing rod;

(b) a work chamber defined in said clamping head; said hydraulic circuit being in communication with said work chamber;

(c) a clamping piston slidably disposed in said work chamber for moving said clamping spring assembly into a clamping position or into a released position;

(d) a control valve contained in said hydraulic circuit for selectively pressurizing or relieving said work chamber of pressure for controlling movements of said clamping piston.

16. The crushing machine as defined in claim 14, wherein said piston rod defines a piston rod chamber into which extends said securing rod; said piston rod chamber having an annular bottom through which said securing rod passes; further wherein said connecting means for attaching said securing rod to said piston comprises a terminal head portion located in said piston rod chamber; said terminal head portion being adapted to abut said annular bottom of said work chamber for preventing said securing rod from entirely moving out of said piston rod chamber.

17. The crushing machine as defined in claim 16, wherein said securing rod has a throughgoing longitudinal channel opening into said piston rod chamber; said hydraulic circuit being in communication with said piston rod chamber through said channel; further comprising a valve contained in said hydraulic circuit for controlling hydraulic pressure admission to said piston rod chamber for pressing said terminal head portion against said annular bottom.

18. The crushing machine as defined in claim 12, wherein said cylinder chamber is a first cylinder chamber; further comprising a second cylinder chamber defined in said cylinder sleeve; said first and second cylinder chambers being separated from one another by said piston; said first and second cylinder chambers communicating with said hydraulic circuit; said hydraulic circuit including means for controlling pressures in said first and second cylinder chambers for displacing said piston and said impact apron.

19. The crushing machine as defined in claim 18, wherein said first and second cylinder chambers are arranged such that pressurization of said first cylinder chamber effects motion of said impact apron toward said impact tools and pressurization of said second cylinder chamber effects motion of said impact apron away from said impact tools; further comprising a hydraulic medium accumulator communicating with said first cylinder chamber and means for adjusting a biasing pressure in said accumulator for limiting a maximum crushing force.

20. The crushing machine as defined in claim 18, wherein said piston has a first piston face bordering said first cylinder chamber and a second piston face bordering said second cylinder chamber; said first and second piston faces have different areas.

21. The crushing machine as defined in claim 18, wherein said hydraulic circuit comprises a remote-controlled pressure limiting valve for limiting a maximum pressure in said first cylinder chamber.

22. The crushing machine as defined in claim 21, wherein said hydraulic circuit includes a leak-free circuit for controlling said pressure limiting valve; a pump for pressurizing hydraulic medium in said hydraulic circuit; means for deenergizing said pump in response to a maximum pressure prevailing in said first cylinder chamber and for energizing said pump in response to a pressure drop in said leak-free circuit.

* * * * *